US005263389A

United States Patent [19]

Frazzell et al.

[11] Patent Number: 5,263,389

[45] Date of Patent: Nov. 23, 1993

[54] TORQUE RATED FLOATING MARINE PROPELLER WRENCH

[75] Inventors: Michael E. Frazzell, Neenah; Michael A. Karls, Hilbert, both of Wis.

[73] Assignee: Brunswick Corp., Skokie, Ill.

[21] Appl. No.: 8,523

[22] Filed: Jan. 25, 1993

[51] Int. Cl.[5] ..... B25B 13/06

[52] U.S. Cl. ..... 81/124.3; 81/900

[58] Field of Search ..... 81/121.1, 124.3, 64, 81/900

[56] References Cited

U.S. PATENT DOCUMENTS

| | | | |
|---|---|---|---|
| 3,836,763 | 9/1974 | Hoffman et al. | 362/374 |
| 3,908,489 | 9/1975 | Yamamoto et al. | 81/124.3 |
| 4,145,938 | 3/1979 | Laird, Jr. | 81/64 |
| 5,022,875 | 6/1991 | Karls . | |

OTHER PUBLICATIONS

"Quicksilver Marine Parts And Accessories", Part 90-18379-92, p. 6, published Third Quarter 1991.

*Fundamentals of Engineering Materials,* Peter Thornton & Vito Colangelo, Prentice-Hall Inc., pp. 588-590, 1985.

*Primary Examiner*—D. S. Meislin

*Attorney, Agent, or Firm*—Andrus, Sceales, Starke & Sawall

[57] ABSTRACT

A floating marine propeller wrench (18) is provided for removing a marine propeller nut (16), and comprises a floating member composed of a material selected to have a specific gravity less than or equal to 1.0, to enable floatation, yet strong enough to apply torque of at least 50 lb.ft. to the nut. The floating member is composed of chemically coupled long glass fiber reinforced polypropylene, particularly ten percent glass by weight, one percent foaming agent by weight, and the balance polypropylene. The material is also selected to provide a user detectable slight deflection (70) of a handle portion (24) when approximately 50 lb.ft. is applied to the nut by a socket portion (22), to provide a combined floating marine propeller wrench and torque meter.

7 Claims, 2 Drawing Sheets

TORQUE RATED FLOATING MARINE PROPELLER WRENCH

BACKGROUND AND SUMMARY

The invention relates to a marine propeller wrench for removing a marine propeller nut.

The invention arose during development efforts directed toward providing a marine propeller wrench which is light enough to float, yet strong enough to apply requisite torque. The wrench must have a specific gravity less than or equal to 1.0, to enable floatation, yet be strong enough to apply torque, in the preferred embodiment of at least 50 lb.ft. to the nut, to satisfy marine torque specifications. These goals of floatation and strength are at cross-purposes. Increasing the floatability of the device requires lighter weight material of reduced torque capability. Increasing the strength of the device for higher torque rating requires a heavier grade member, which will sink if its specific gravity is greater than 1.0.

The present invention provides a marine propeller wrench combination affording both floatation and strength.

DETAILED DESCRIPTION

Figure 1:
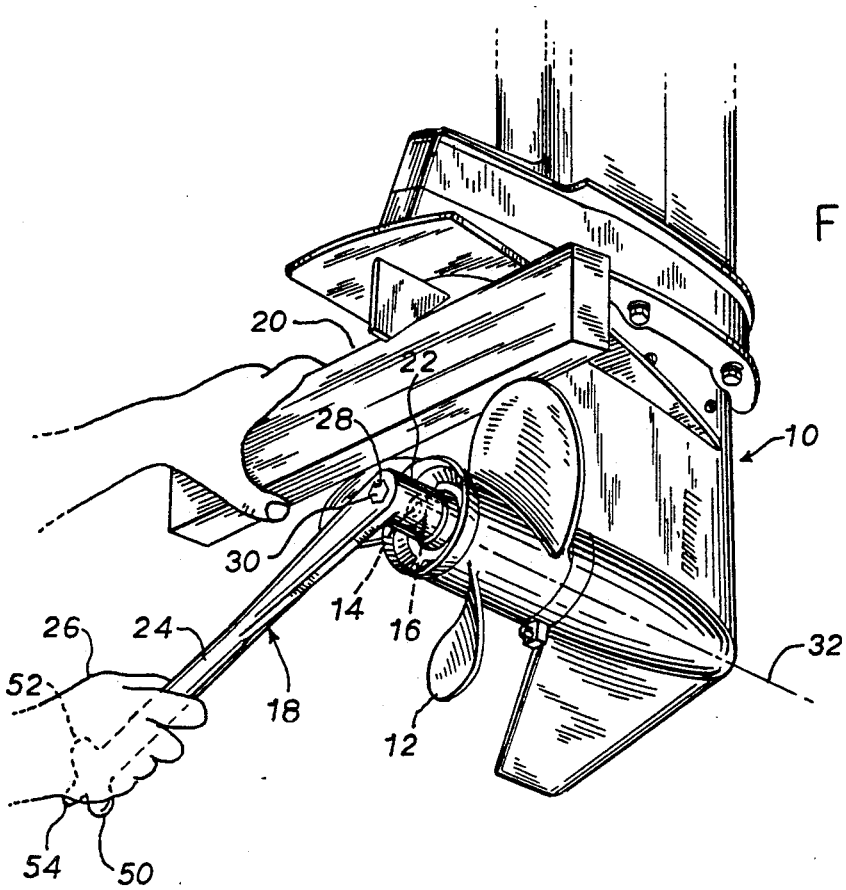
FIG. 1 shows a marine drive and a propeller wrench in accordance with the invention.

FIG. 1 shows the lower portion of a marine drive 10 having a propeller 12 held on a propeller shaft 14 by a nut 16. In the present invention, a floating marine propeller wrench 18 is provided for loosening and tightening marine propeller nut 16. The propeller is preferably held against rotation by a two-by-four 20 or other suitable temporary interference member.

Figure 2:
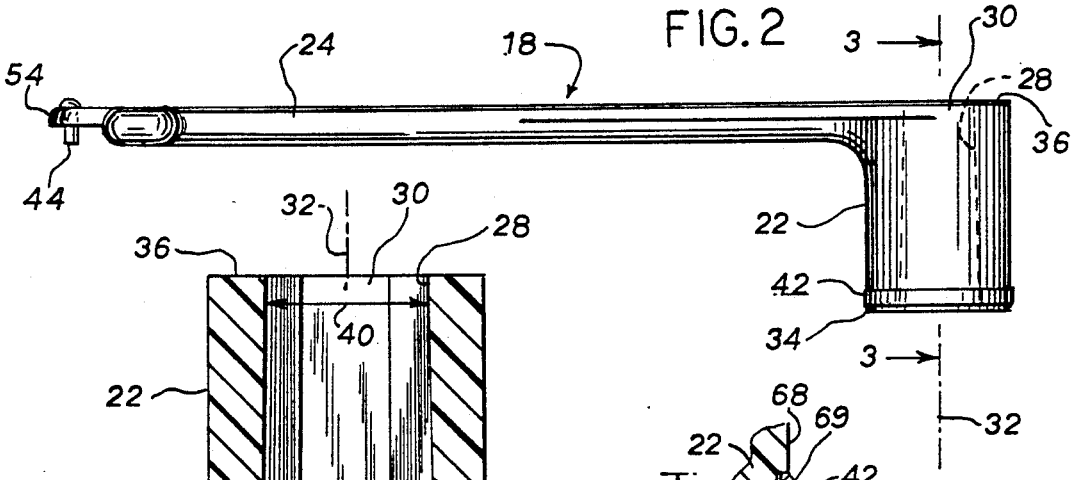
FIG. 2 is a side view of the propeller wrench of FIG. 1.
Figure 3:
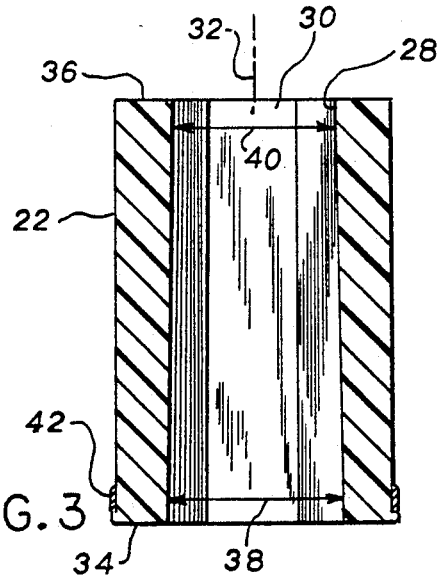
FIG. 3 is a sectional view taken along line 3—3 of FIG. 2.
Figure 7:
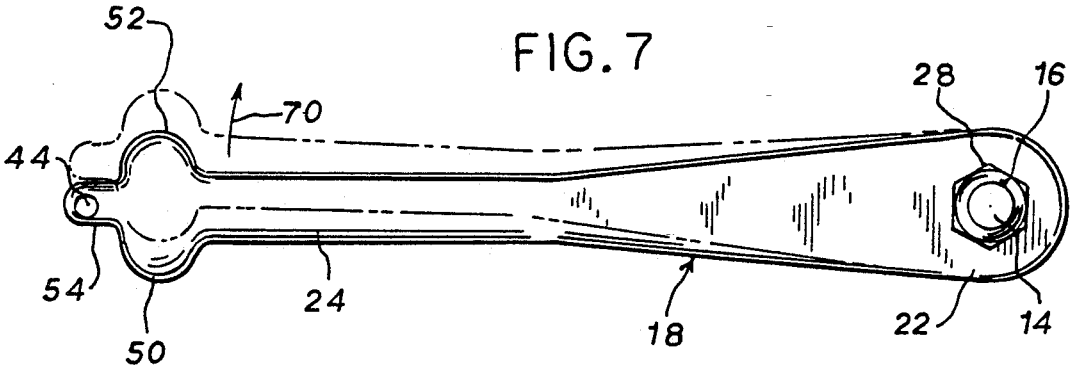
FIG. 7 is an end view of the wrench of FIG. 1.

Wrench 18 has a socket portion 22 for engaging nut 16, and a handle portion 24 extending from the socket portion for gripping by the hand 26 of the user. Socket portion 22 has an inner hex profile 28, FIGS. 1, 2 and 7, keyed to and mating with nut 16. Profile 28 is provided by a bore 30 which extends along an axial direction 32 along the rotational axis of the propeller. Socket portion 22 has a forward end 34, FIG. 2, engaging nut 16. Socket portion 22 extends axially rearwardly to a rearward end 36. Bore 30 has a diameter 38 at forward end 34 and tapers to smaller diameters as bore 30 extends axially rearwardly, with the smallest diameter 40 being at rearward end 36. The tapering of inner profile 28 along an axial direction parallel to the rotational axis 32 of the propeller enables socket portion 22 of wrench 18 to be easily slid onto nut 16, and provides a tighter closer tolerance fit as socket portion 22 is slid forwardly all the way onto nut 16 to provide better gripping thereof, and hence less chance of stripping or other deformation of inner profile 28 which is provided by a much softer material, preferably a particular polypropylene blend, to be described, than nut 16. The noted tapering is also desirable because it facilitates draft withdrawal from the forming mold for the injection molded wrench of blended polypropylene material, to be described.

In developing the wrench of the present invention, material selection and proportions were found to be of critical significance. Various materials were available having a specific gravity less than or equal to 1.0, i.e. less than or equal to water, such that the wrench would float. However, mere application of such materials to a wrench as described was not found to be satisfactory, particularly the strength requirements necessary to apply torque of at least about 50 lb.ft. to nut 16 to adequately torque and mount propeller 12 to propeller shaft 14, and also to loosen same for propeller replacement. It has been found that a floating member of blended polypropylene for wrench 18 satisfies the conflicting requirements of floatation and strength. In particular, it has been found that a floating member composed of chemically coupled sized long glass fiber reinforced polypropylene enables floatation and yet is strong enough to apply torque of at least 50 lb.ft. to nut 16, where such floating member is composed of approximately 10% glass by weight, approximately 1% foaming agent by weight, and the balance polypropylene, where the long glass fibers have a length of at least about one quarter inch. The glass content may vary from 5 to 15 percent by weight. The foaming agent may vary from 0.5 to 1.5 percent by weight. Strength may be increased by adding more glass, however this also increases specific gravity, and hence reduces floatability. It has been found that the above noted mix enables both sufficient strength and floatation.

It is preferred that long glass fibers, i.e. having a length of at least about one quarter inch, be used, for added strength, particularly tensile strength. In an alternate embodiment where cost reduction is desired, short glass fibers, e.g. about 1/32 of an inch, may be used.

It is preferred that a foaming agent be used, as noted above, to further reduce the specific gravity of the floating member, which in turn enables the noted addition of glass fibers for strength. It is preferred that an endothermic type foaming agent be used to cool the material during molding. An exothermic foaming agent may be used if the extra heat added thereby may be accommodated during the molding process.

The noted sizing and chemical coupling is preferred during the mixing formulation of the polypropylene and glass fibers such that the polypropylene bonds to the glass fibers. Without this sizing and chemical coupling, the fiber may slide through the polypropylene under load, which destroys the torque bearing capability of the wrench. With the sizing and chemical coupling, the glass fiber must break tensiley before the polypropylene lets go of the glass fiber.

The noted formulation also provides a strength to specific gravity ratio, and particularly a low enough specific gravity such as 0.96, noted below, enabling an additional metal ring member 42 to be added to socket portion 22 for additional hoop strength and torque rating, while still maintaining the overall specific gravity of wrench 18 at a value enabling floatation. The noted formulation further enables the addition of a metal pin member 44 for unlocking a marine propeller locking tab type washer as shown in U.S. Pat. No. 5,022,875, incorporated herein by reference, while still enabling floatation of the wrench.

In combination with ring 42 and pin 44, wrench 18 is preferably composed of a material as noted in the following table, where the first leftmost column notes the property, the second column notes the ASTM (American Society For Testing and Materials) method by test number, the third column notes the units, and the fourth column indicates the specific grade used in propeller wrench 18, and which is commercially available from LNP Engineering Plastics, Inc., a division of ICI Advanced Materials, 4705 Creamery Way, Exton, Pa. 19341, under the specification VERTON PDX-M-87242.

| Property | ASTM Method | Units | Verton PDX-M-87242 |
|---|---|---|---|
| Physical | | | |
| Specific Gravity | D 792 | | 0.96 |
| Shrinkage | D 955 | % @ 0.125" thick | .8-1.0 |
| Melt Point (Resin) | D 3418 | °F. | 325 |
| Water Absorption | D 570 | % | 0.02 |
| Mechanical | | | |
| Tensile Strength | D638 | PSI (pounds per square inch) | 7,000 |
| Tensile Elongation | D638 | % | 3-5 |
| Flexural Strength | D 790 | PSI | 7,500 |
| Flexural Modulus | D 790 | PSI | 375,000 |
| Izod Impact (Cut Notch) | D 256 | FT-LB/IN | 1.5 |
| Izod Impact (Unnotched) | D 256 | FT-LB/IN | 7-9 |
| Thermal | | | |
| H.D.T.U.L. (Heat Deflection Temperature Under Load) (DEG F.; @ 264 PSI) | D 648 | °F. | 275 |

It has been found that the above formulation is particularly suitable to a floating marine propeller wrench with increased hoop strength provided by reinforcing ring 42 provided by a member having a tensile strength of at least about 75,000 PSI and a weight less than about 0.25 ounce. Ring 42 is an annular stainless steel member having an annular thickness 46, FIG. 4, of about 0.035 inch, and a height 48 of about 0.2 inch. Thickness 46 is along a radial direction relative to propeller rotational axis 32. Height 48 is along an axial direction parallel to axis 32.

Figure 5:
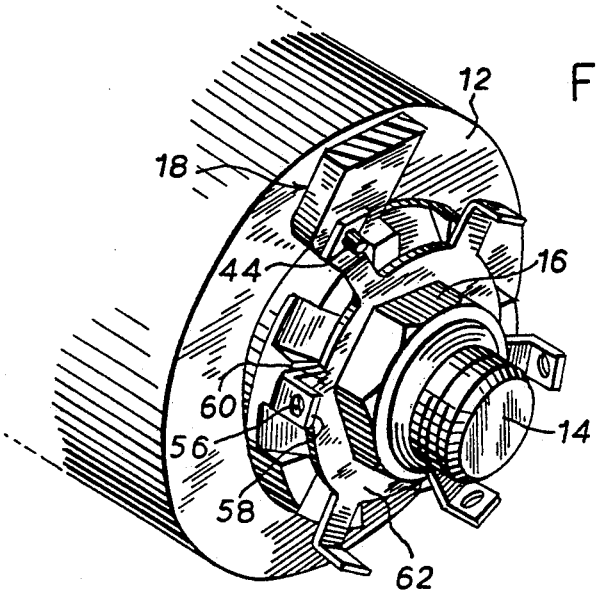
FIG. 5 is a perspective view of a portion of the structure of FIG. 1.
Figure 6:
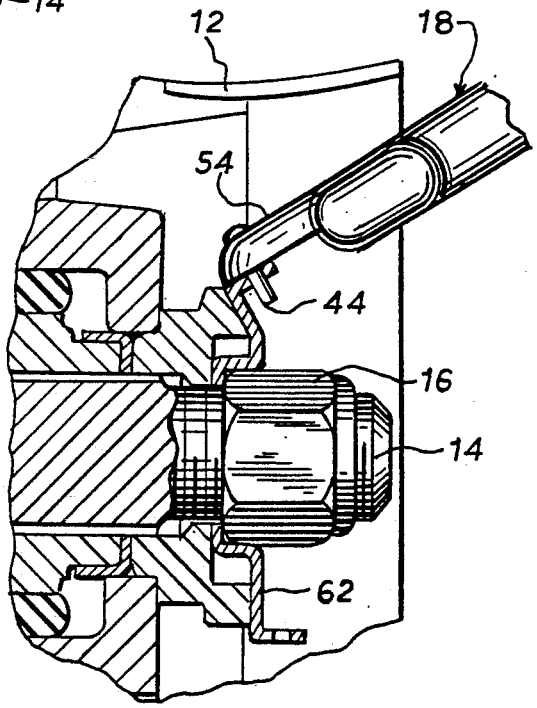
FIG. 6 is a partial sectional side view of the structure of FIG. 5.

Handle portion 24 includes nubs 50 and 52 extended oppositely therefrom, and a tab portion 54 through which pin 44 extends. Pin 44 is provided for engaging a hole 56, FIGS. 5 and 6, in an ear 58 extending from a locking tab 60 of a locking tab type marine propeller washer 62, as shown in incorporated U.S. Pat. No. 5,022,875, to bend the tab to unlock the washer. The noted composition of the material of floating member 18 has a specific gravity sufficiently less than 1.0 to compensate for both metal pin 44 and metal ring 42, to enable floatation of floating member 18 with ring 42 and pin 44 attached thereto, and has sufficient strength to apply at least 50 lb.ft. to nut 16.

Figure 4:
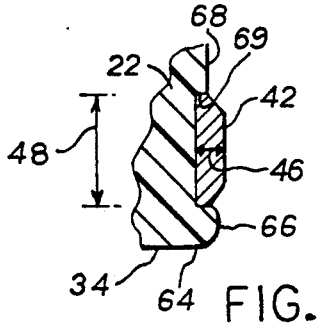
FIG. 4 is an enlarged view of a portion of FIG. 3.

In the preferred embodiment, forward end 34 of socket portion 22 is hot swaged at 64, FIG. 4, to an outer diameter portion 66 greater than outer diameter portion 68, to retain reinforcing ring 42 against shoulder 69.

The present invention further provides a combined floating marine propeller wrench and torque meter. The above noted formulation not only provides both floatation and sufficient strength to apply at least 50 lb.ft. to nut 16, but also provides sufficient deflection to provide a slight yet user perceptible deflection, as shown at arrow 70, FIG. 7, when approximately 50 lb.ft. is applied to nut 16 by socket portion 22, to provide torque indication. When the user senses deflection 70, he knows that nut 16 is properly torqued to requisite marine specifications. This torque meter function is particularly desirable for a floating marine propeller wrench because such type of wrench is typically used in an emergency situation or otherwise when the user is in the water with the boat and does not have the time, patience or tools to ensure the proper torquing of nut 16 on propeller shaft 14. The present invention provides a simple effective torque meter providing simple deflective feedback to the user when proper torque is reached.

It is recognized that various equivalents, alternatives and modifications are possible within the scope of the appended claims.

We claim:

1. A floating marine propeller wrench for removing a marine propeller nut, comprising a floating member composed of approximately 5 to 15 percent glass by weight, approximately 0.5 to 1.5 percent foaming agent by weight, and the balance polypropylene.

2. The invention according to claim 1 wherein said floating member is composed of chemically coupled long glass fiber reinforced polypropylene.

3. The invention according to claim 2 wherein said floating member is composed of chemically coupled long glass fiber reinforced polypropylene of the following properties:

| Property | ASTM Method | |
|---|---|---|
| Physical | | |
| Specific Gravity | D 792 | 0.96 |
| Shrinkage | D 955 | .8-1.0% @ 0.125" thick |
| Melt Point (Resin) | D 3418 | 325° F. |
| Water Absorption | D 570 | 0.02% |
| Mechanical | | |
| Tensile Strength | D638 | 7,000 PSI (pounds per square inch) |
| Tensile Elongation | D638 | 3-5% |
| Flexural Strength | D 790 | 7,500 PSI |
| Flexural Modulus | D 790 | 375,000 PSI |
| Izod Impact (Cut Notch) | D 256 | 1.5 FT-LB/IN |
| Izod Impact (Unnotched) | D 256 | 7-9 FT-LB/IN |
| Thermal | | |
| H.D.T.U.L. (Heat Deflection Temperature Under Load) (DEG F.; @ 264 PSI) | D 648 | 275° F. |

4. A floating marine propeller wrench for removing a marine propeller nut, comprising a floating member having a socket portion for engaging said nut and a handle portion extending from said socket portion, and a reinforcing ring around said socket portion having a tensile strength of at least about 75,000 PSI and a weight less than about 0.25 ounce.

5. The invention according to claim 4 wherein said ring is an annular stainless steel member having an annular thickness of about 0.035 inch, and a height of about 0.2 inch, said thickness being along a radial direction relative to the propeller rotational axis, said height being along an axial direction parallel to said axis.

6. The invention according to claim 4 further comprising in combination a pin extending from said member for engaging a hole in a locking tab of a locking tab type marine propeller washer, to bend the tab to unlock the washer, wherein in combination said ring and said pin are metal, and said floating member is composed of a material having a specific gravity sufficiently less than 1.0 to compensate for said metal ring and metal pin, to enable floatation of said floating member with said ring and said pin attached thereto.

7. The invention according to claim 6 wherein said floating member is composed of chemically coupled long glass fiber reinforced polypropylene.

* * * * *